US009187864B1

(12) United States Patent
Svec et al.

(10) Patent No.: US 9,187,864 B1
(45) Date of Patent: Nov. 17, 2015

(54) APPARATUS AND METHODS OF MANUFACTURING FIBROUS NONWOVEN MATERIALS AND PRODUCTS COMPRISING THE SAME

(71) Applicant: BUILDING MATERIALS INVESTMENT CORPORATION, Dallas, TX (US)

(72) Inventors: James A. Svec, Kearny, NJ (US); Paul G. Wilson, Waxahachie, TX (US); Margie Ann Beerer, Ennis, TX (US); Jacob Stephen Zhanel, Ennis, TX (US)

(73) Assignee: BUILDING MATERIALS INVESTMENT CORPORATION, Dallas, TX (US)

( * ) Notice: Subject to any disclaimer, the term of this patent is extended or adjusted under 35 U.S.C. 154(b) by 0 days.

(21) Appl. No.: 14/448,961

(22) Filed: Jul. 31, 2014

Related U.S. Application Data

(63) Continuation of application No. 14/063,916, filed on Oct. 25, 2013, now Pat. No. 8,834,681.

(60) Provisional application No. 61/719,352, filed on Oct. 26, 2012.

(51) Int. Cl.
*D21F 1/48* (2006.01)
*D21F 5/14* (2006.01)

(52) U.S. Cl.
CPC ..... *D21F 5/14* (2013.01)

(58) Field of Classification Search
USPC ..... 162/272, 217, 135
See application file for complete search history.

(56) References Cited

U.S. PATENT DOCUMENTS

| | | | |
|---|---|---|---|
| 4,135,029 | A | 1/1979 | Pfeffer |
| 4,258,098 | A | 3/1981 | Bondoc et al. |
| 5,914,365 | A | 6/1999 | Chang et al. |
| 6,582,555 | B2 | 6/2003 | Capizzi et al. |
| 6,642,299 | B2 | 11/2003 | Wertz et al. |
| 6,730,171 | B2 | 5/2004 | Capizzi et al. |
| 6,761,800 | B2 | 7/2004 | Capizzi |
| 6,797,116 | B2 | 9/2004 | Capizzi |
| 6,797,319 | B2 | 9/2004 | Capizzi |
| 6,835,418 | B2 | 12/2004 | Capizzi |
| 6,852,196 | B2 | 2/2005 | Capizzi |
| 7,897,015 | B2 | 3/2011 | Liu et al. |
| 2002/0092635 | A1 | 7/2002 | Capizzi |
| 2003/0084843 | A1 | 5/2003 | Capizzi et al. |
| 2003/0119404 | A1 | 6/2003 | Belau et al. |
| 2003/0119412 | A1 | 6/2003 | Sayovitz et al. |
| 2003/0221808 | A1 | 12/2003 | Capizzi |
| 2004/0079502 | A1 | 4/2004 | Capizzi |
| 2004/0234804 | A1 | 11/2004 | Liu et al. |

*Primary Examiner* — Mark Halpern
(74) *Attorney, Agent, or Firm* — Baker & McKenzie LLP

(57) ABSTRACT

In an exemplary embodiment, the disclosed drying and dewatering system comprises an air knife and a vacuum slot, wherein the air knife is positioned over the vacuum slot and fibrous nonwoven material is passed under the air knife and over the vacuum slot. The embodiments of the present disclosure may be used to achieve greater water removal and more uniform binding agent distribution across the nonwoven fibrous material.

17 Claims, 6 Drawing Sheets

APPARATUS AND METHODS OF MANUFACTURING FIBROUS NONWOVEN MATERIALS AND PRODUCTS COMPRISING THE SAME

CROSS-REFERENCE TO RELATED APPLICATIONS

This application is a continuation of and claims priority to U.S. patent application Ser. No. 14/063,916, entitled "Apparatus and methods of manufacturing fibrous nonwoven materials and products comprising the same," filed on Oct. 25, 2013, which is a nonprovisional application of, and thus claims priority to, U.S. Provisional Patent Application No. 61/719,352, filed Oct. 26, 2012, both of which are incorporated herein by reference in their entirety.

TECHNICAL FIELD

The present disclosure relates generally to fibrous nonwoven materials and more specifically to apparatus and methods of manufacturing same and products comprising same.

BACKGROUND

Fibrous nonwoven materials have gained continued acceptance for a wide range of applications. Applications for such materials include, but are not limited to, roof shingles, siding and floor underlayment, insulation facers, floor and ceiling tiles, and vehicle parts.

The term "nonwoven" may refer to textile products produced by bonding or interlocking fibers (or both) accomplished by mechanical, chemical, thermal or solvent means, or even a combination thereof.

The term "wet-laid fibrous nonwoven materials" may refer to fibrous nonwoven materials prepared through a wet-laid process wherein solution or fluid removal may be performed.

SUMMARY

Disclosed herein are various embodiments of a system and method for drying and dewatering wet-laid fibrous nonwoven materials and promoting uniform binding agent distribution thereof. In an embodiment, a disclosed system may comprise an air knife and a vacuum slot, wherein the air knife may be positioned over the vacuum slot. Wet-laid fibrous nonwoven material may be set up on a forming wire, and a fibrous nonwoven material and a forming wire may be passed under an air knife and/or over a vacuum slot.

In some embodiments, an apparatus for preparing a nonwoven fibrous material may comprise an air knife, a slot defined in a surface of a vacuum device operable to draw air through the slot; and a movable forming wire structure. An air knife and a surface of the vacuum device may be spaced apart by a gap. A gap may be configured to have a height which may be sufficient to allow a fibrous material to pass through the gap. An air knife may be oriented at substantially perpendicular angles relative to a plane defined by a movable forming wire.

In some embodiments, an air knife may be operable to emit air towards a movable forming wire structure. In some embodiments, an air knife may be operable to emit air about 25 mph to about 30 mph (e.g., about 28 mph). In some embodiments, an air knife may be operated or controlled at a maximum, wherein a maximum may be related to whether the operating conditions may cause fibers to be blown off a wire. In some embodiments, an air knife may be set to a desired operating setting not beyond a destructive maximum. In some embodiments, a gap may be about 8 mm. In some embodiments, a manifold may be operable to distribute air flow through an air knife. In some embodiments, a compressor may be operable to promote even distribution of air flow through an air knife. In some embodiments, a solenoid valve may be operable to cut off air flow to an air knife. In some embodiments, an air flow direction provided by an air knife and a vacuum direction provided by a vacuum device may be co-linear. In some embodiments, a movable forming wire structure may be operable to transport a fibrous material in a direction defined by a plane of a movable forming wire. In some embodiments, a movable forming wire structure may allow fluids to pass therethrough.

The present disclosure relates, in some embodiments, to methods for providing a non-woven fibrous material preparation apparatus. In some embodiments, a method for providing a non-woven fibrous material preparation apparatus may comprise providing an air knife operable to emit air, providing a slot defined on a surface of a vacuum device operable to draw through the slot, and providing a movable forming wire structure between an air knife and a slot. A method may comprise (a) forming a negative pressure at a first surface of a plate, wherein the plate has a slot spanning its thickness from the first surface to a second surface and the slot is in fluid communication with the negative pressure; (b) forming a positive pressure air flow (e.g., a substantially constant velocity air flow) at a distance from the second surface; (c) directing the positive pressure air flow toward the slot, and (d) contacting a fibrous nonwoven material with the positive pressure air flow. Contacting a fibrous nonwoven material with a positive pressure air flow may further comprise passing the fibrous nonwoven material between the positive pressure air flow and the second surface. Passing a fibrous nonwoven material between a positive pressure air flow and a second surface may further comprise contacting (e.g., attaching) the fibrous nonwoven material with a movable forming wire and translating the wire relative to the second surface. A method may further comprise removing (e.g., detaching) cut fibrous nonwoven material from the wire. A positive pressure air flow may be directed towards a slot at any desired angle including, for example, an angle substantially perpendicular to the second surface. Forming a negative pressure at a first surface of a plate may further comprise forming and maintaining a negative pressure (e.g., a substantially constant negative pressure) at a first surface of a plate.

In some embodiments, methods for preparing a non-woven fibrous material are provided. Methods may comprise providing a movable forming wire structure, passing a fibrous material on a movable forming wire structure; emitting air at a fibrous material using an air knife, and providing suction on a fibrous material using a vacuum device. An air knife may be disposed above a movable forming wire structure at substantially perpendicular angles relative to a plane defined by a movable forming wire. A vacuum device may be operable to draw air through a slot defined in a surface of a vacuum device.

BRIEF DESCRIPTION OF THE DRAWINGS

Features, aspects, and embodiments of the disclosure are described in conjunction with the attached drawings, in which.

DETAILED DESCRIPTION

Figure 1:
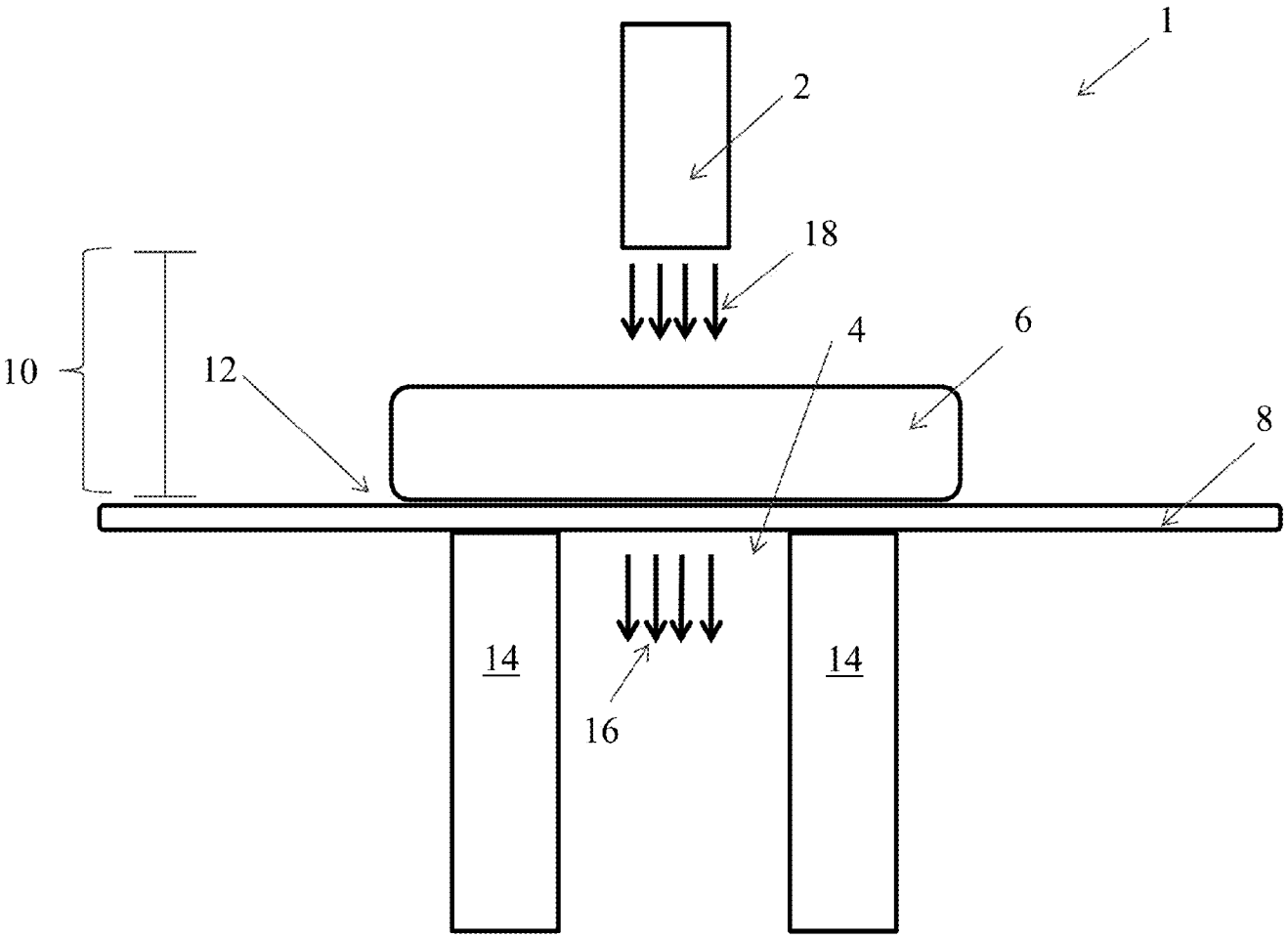
FIG. 1 is a partial, perspective view of a drying and dewatering system in accordance with a specific example embodiment of the disclosure.

Exemplary fibrous nonwoven materials and methods of making the same have been described in U.S. Pat. Nos. 4,135,029, 4,258,098, 5,914,365, and 6,642,299 which are incorporated by reference herein. Glass fiber mats may be made from glass fibers held together by a binding agent through a wet-laid process. Specifically, a slurry of glass fibers may be made by adding glass fiber strands to a pulper to disperse the fiber in the white water. The slurry mixture may then to be dewatered to form a continuous wet-laid fibrous nonwoven mat. A binding agent may then be applied to the mat to bond the randomly dispersed fibers in their respective locations and directions. In wet processed glass fiber mats, the binding agent may be applied in liquid form and dispersed onto the glass fibers by an applicator. Uniform distribution of such binding agent throughout the glass fiber mat may be desirable. After the binding agent and glass fibers have been dried and cured, the glass fiber mat may be cut as desired.

A possible problem in the manufacturing process of wet-laid fibrous nonwoven materials is efficient drying of the wet mat. Various approaches may be used for drying fibrous nonwoven mats, including the use of vacuum systems or heating devices. The performance of such approaches may be dependent on line speeds and heater capacity.

Another possible problem in the manufacturing process of wet-laid fibrous nonwoven materials is achieving uniform distribution of the binding agent. Binding agent makes an integral mat of the randomly dispersed fibers in the mat. During the binding agent application process, binding agent may collect towards the bottom of the mat and/or between the bottom of the mat and the forming wire. This collection may negatively impact the uniform binding agent distribution in the wet-laid fibrous nonwoven material.

Some embodiments of the present disclosure may include fibrous nonwoven material manufacturing processes that may lower demands on heaters, allow for increased line speeds, and/or promote more uniform binding agent distribution.

For a more complete understanding of the present disclosure and its advantages, reference is now made to the following description taken in conjunction with the accompanying drawings, in which like reference numbers indicate like features. Persons having ordinary skill in the art will understand other varieties for implementing example embodiments, including those described herein. The drawings are not limited to specific scale. As used in the disclosures and the appended claims, the terms "example embodiment," "exemplary embodiment," and "present embodiment" do not necessarily refer to a single embodiment, although it may, and various example embodiments may be readily combined and interchanged, without departing from the scope or spirit of the present disclosure. Furthermore, the terminology as used herein is for the purpose of describing example embodiments only and is not intended to be a limitation of the disclosure.

As stated above, some embodiments of the present disclosure relate generally to a system and method for drying and dewatering wet-laid fibrous nonwoven materials and promoting uniform binding agent distribution thereof. In some embodiments, a system may comprise an air knife and a vacuum slot, wherein an air knife may be positioned over a vacuum slot.

FIG. 1 is a partial, perspective view of drying and dewatering system 1. System 1 may comprise air knife 2 and vacuum slot 4, and may be operable to dry and dewater wet-laid fibrous nonwoven material 6. Wet-laid fibrous nonwoven material 6 may be a textile product produced by bonding or interlocking fibers (or both) through mechanical, chemical, thermal or solvent means, or even a combination thereof. In some examples, wet-laid fibrous nonwoven material 6 may include a nonwoven glass fiber material. Glass fiber mats may be made from the nonwoven glass fiber materials through a wet-laid process. Specifically, slurries of glass fibers may be made by adding glass fiber strands to a pulper to disperse the fiber in the white water. A slurry mixture may then be dewatered to form a continuous wet-laid fibrous nonwoven mat. A binding agent may then be applied to a mat to bond randomly dispersed fibers in their respective locations and directions.

In some embodiments, system 1 may further include forming wire 8. Wet-laid fibrous nonwoven material 6 may be placed on forming wire 8, wherein forming wire 8 may be operable to provide structural support for wet-laid fibrous nonwoven material 6. Wet-laid fibrous nonwoven material 6 and forming wire 8 may be operable to pass under air knife 2 and over vacuum slot 4.

In some embodiments, air knife 2 may be positioned above vacuum slot 4, and wet-laid fibrous nonwoven material 6 may be positioned under air knife 2 and over vacuum slot 4. Air knife 2 is operable to force air at high velocity through wet-laid fibrous nonwoven material 6 thereby pushing and forcing residual liquid from wet-laid fibrous nonwoven material 6 into vacuum slot 4. Vacuum slot 4, positioned below wet-laid fibrous nonwoven material 6, may be operable to facilitate and enhance the extraction of residual liquid from wet-laid fibrous nonwoven material 6 by exerting a pulling force on residual liquid in wet-laid fibrous nonwoven material 6.

It is to be appreciated that vacuum slot 4 may be defined in surface 12 of vacuum device 14. Vacuum device 14 may be operable to provide suction or provide a vacuum through vacuum slot 4 in direction 16. Direction 16 may be substantially parallel to direction 18, which may correspond to a direction of an air output from air knife 2. In some embodiments, direction 16 and direction 18 may be co-linear. Air knife 2 may be oriented at various angles relative to plane defined by moving forming wire 8 in which wet-laid fibrous nonwoven material 6 would travel through system 1. In some embodiments, air knife 2 may be positioned at angles that may be substantially perpendicular to a plane defined by moving forming wire 8, a plane on which wet-laid fibrous nonwoven material 6 may travel through. Wet-laid fibrous nonwoven material 6 may have a fragile intermediate structure, and a substantially perpendicular orientation of air knife 2 may substantially preserve structural integrity of wet-laid fibrous nonwoven material 6. In some embodiments, system 1 may be configured to dry or dewater a sturdier material (not shown) comprising a higher structural integrity. Air knife 2 may be oriented at other angular positions, such as 45 degrees, to maximize a turbulent air flow through a sturdier material without concerns about compromising the material's structural integrity.

Figure 2:
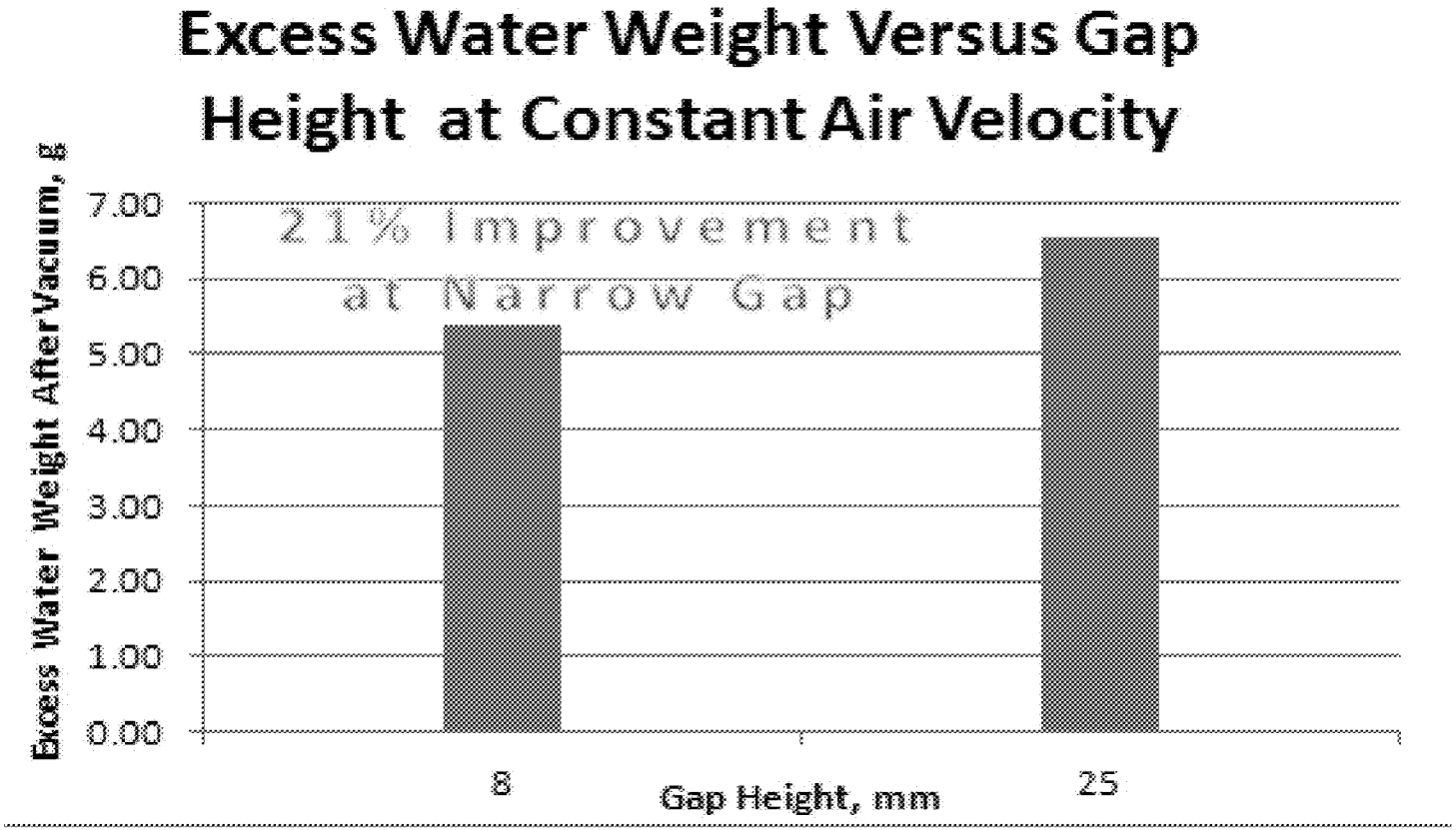
FIG. 2 sets forth the results of excess water weight after drying and dewatering when the vertical spacing was 8 mm and when the vertical spacing was 25 mm.

In some embodiments, vertical spacing 10 between air knife 2 and forming wire 8 may be about 8 mm. Experiments varying in a vertical spacing between air knife 2 and wet-laid fibrous nonwoven material 6 were conducted. FIG. 2 sets forth experimental results comparing excess water weights after drying when a vertical spacing was 8 mm and when a vertical spacing was 25 mm. As seen in FIG. 2, narrower gaps of 8 mm demonstrated advantageous drying performance in some embodiments. It is to be appreciated that vertical spacing 10 between air knife 2 and wet-laid fibrous nonwoven material 6 may be adjusted according to the principles disclosed in the present disclosure. In some embodiments, vertical spacing 10 may be adjusted to achieve certain drying or dewatering efficiencies or to optimize preservation of a structure integrity of fibrous nonwoven materials passing through system 1.

Figure 3:
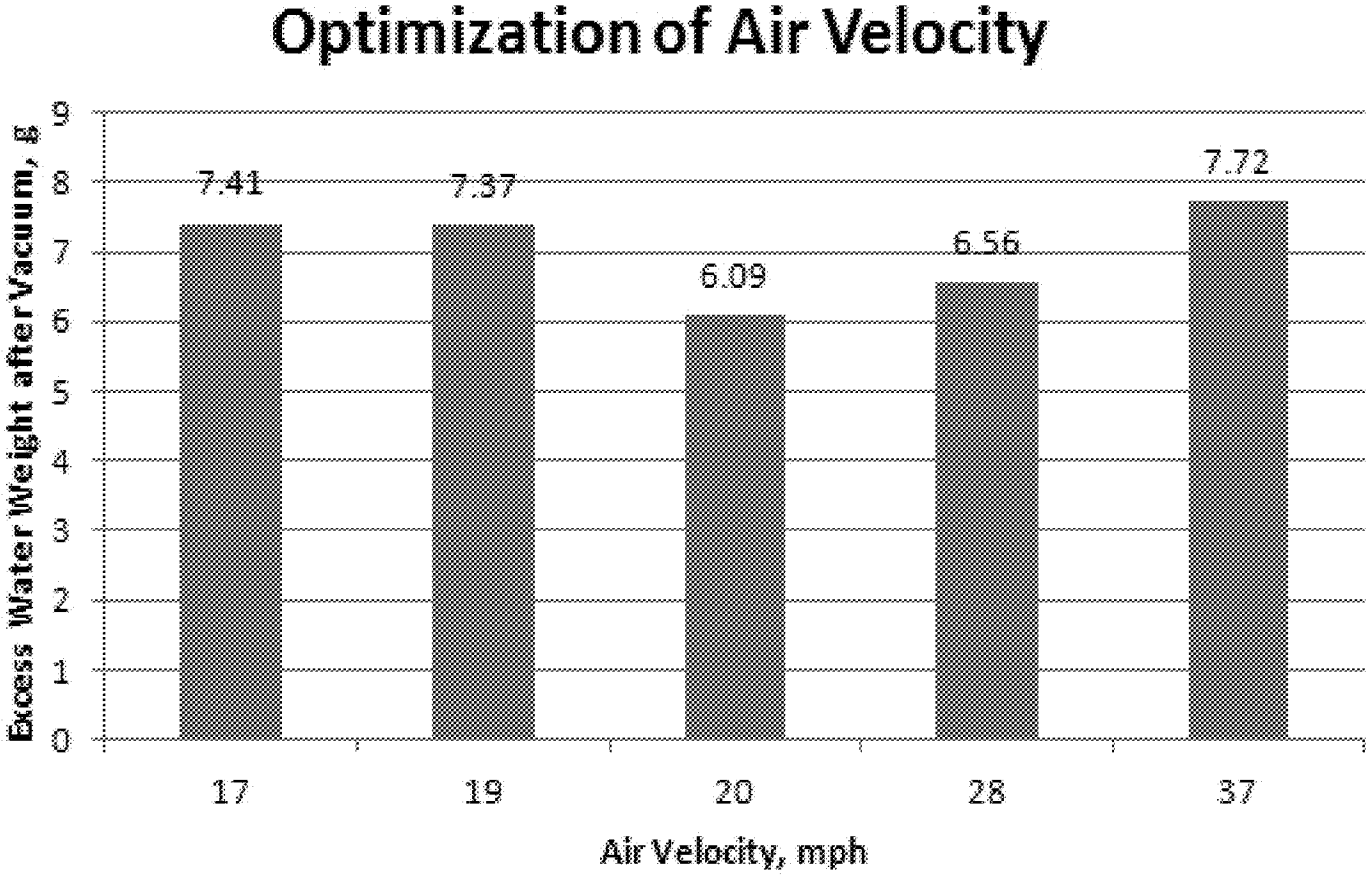
FIG. 3 sets forth the results of excess water weight after drying and dewatering when air velocities were 17, 19, 20, 28, and 37 mph.

In some embodiments, an air velocity of air knife 2 may be about 6 mph. Experiments varying in air velocities of air knife 2 were conducted. FIG. 3 sets forth experimental results comparing the excess water weight after drying for a range of air velocities tested. As shown in the experimental results, efficient drying performance may be achieved in an embodiment at air velocities close to 20 mph. It is to be appreciated that an air velocity of air knife 2 may be adjusted according to the principles disclosed in the present disclosure. In some embodiments, an air velocity of air knife 2 may be adjusted to achieve certain drying or dewatering efficiencies or to optimize the preservation of the structure integrity of the fibrous nonwoven materials passing through system 1.

In some embodiments, system 1 may further include a compressor connected through an accumulator and a manifold. A compressor may serve to promote even distribution of air flow through air knife 2. In some embodiments, system 1 may further include a compressor connected through an accumulator and a manifold, with a solenoid valve positioned after the accumulator. The solenoid valve may serve to cut off air flow to air knife 2.

Figure 4:
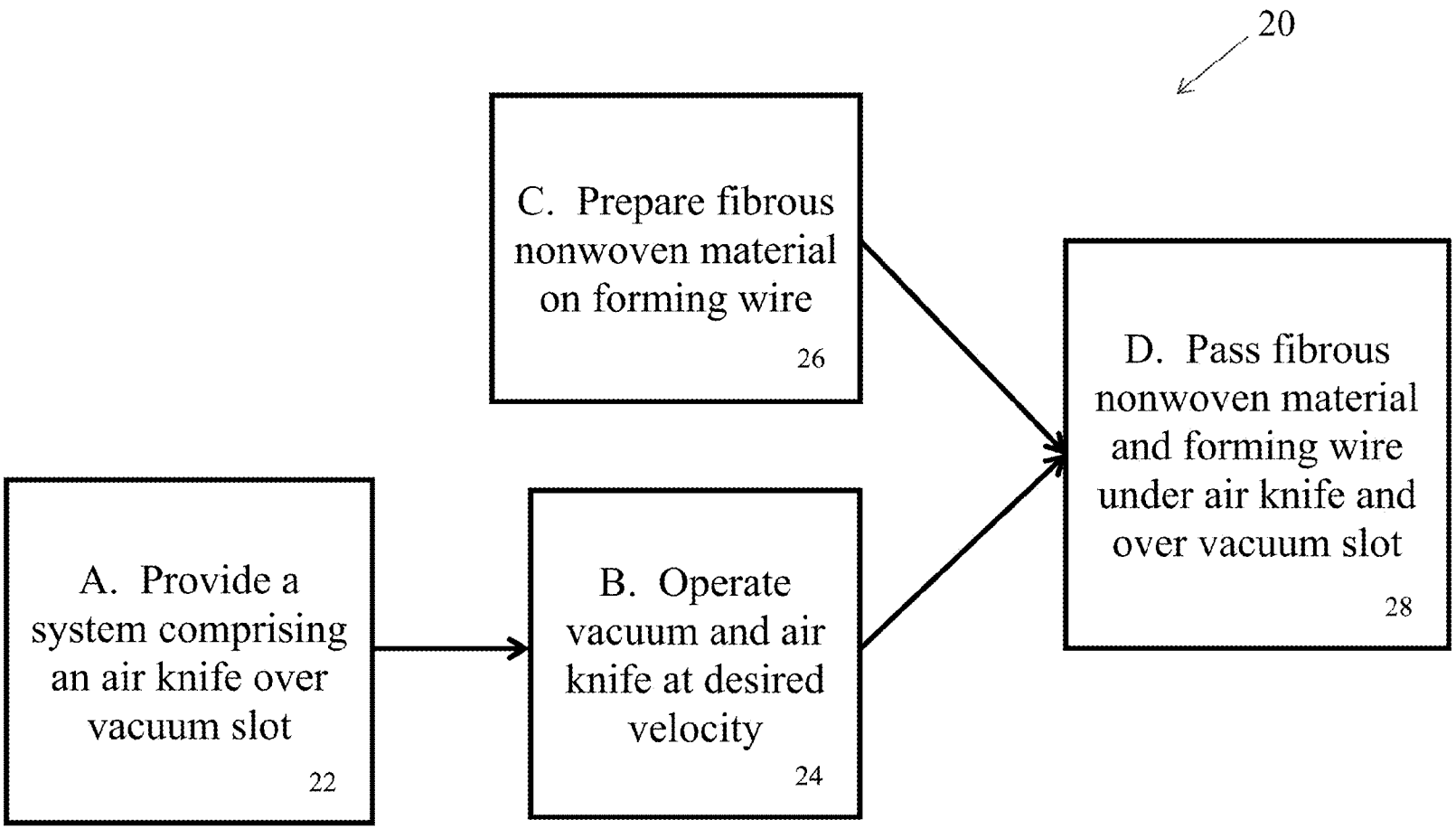
FIG. 4 is a schematic block diagram illustrating a method of drying and dewatering fibrous nonwoven materials in accordance with a specific example embodiment of the disclosure.

FIG. 4 is a schematic block diagram illustrating an operation 20 of drying and dewatering wet-laid fibrous nonwoven materials 6 with drying system 1. Steps 22 and 24 illustrate the configuration of air knife 2 and vacuum slot 4 in drying system 1. In step 22, air knife 2 may be set up over vacuum slot 4. In step 24, vacuum slot 4 and air knife 2 are operated at the desired velocities. Step 26 illustrates the preparation of the wet-laid fibrous nonwoven material 6 which may involve placing wet-laid fibrous nonwoven material 6 on forming wire 8. The order of steps 22 and 24 with respect to step 26 may be varied. Step 26 may be performed before, after, or contemporaneously with steps 22 and 24. In step 28, fibrous nonwoven material 6 and forming wire 8 may be passed under air knife 2 and over vacuum slot 4 for extraction of residual liquid.

Figure 5:
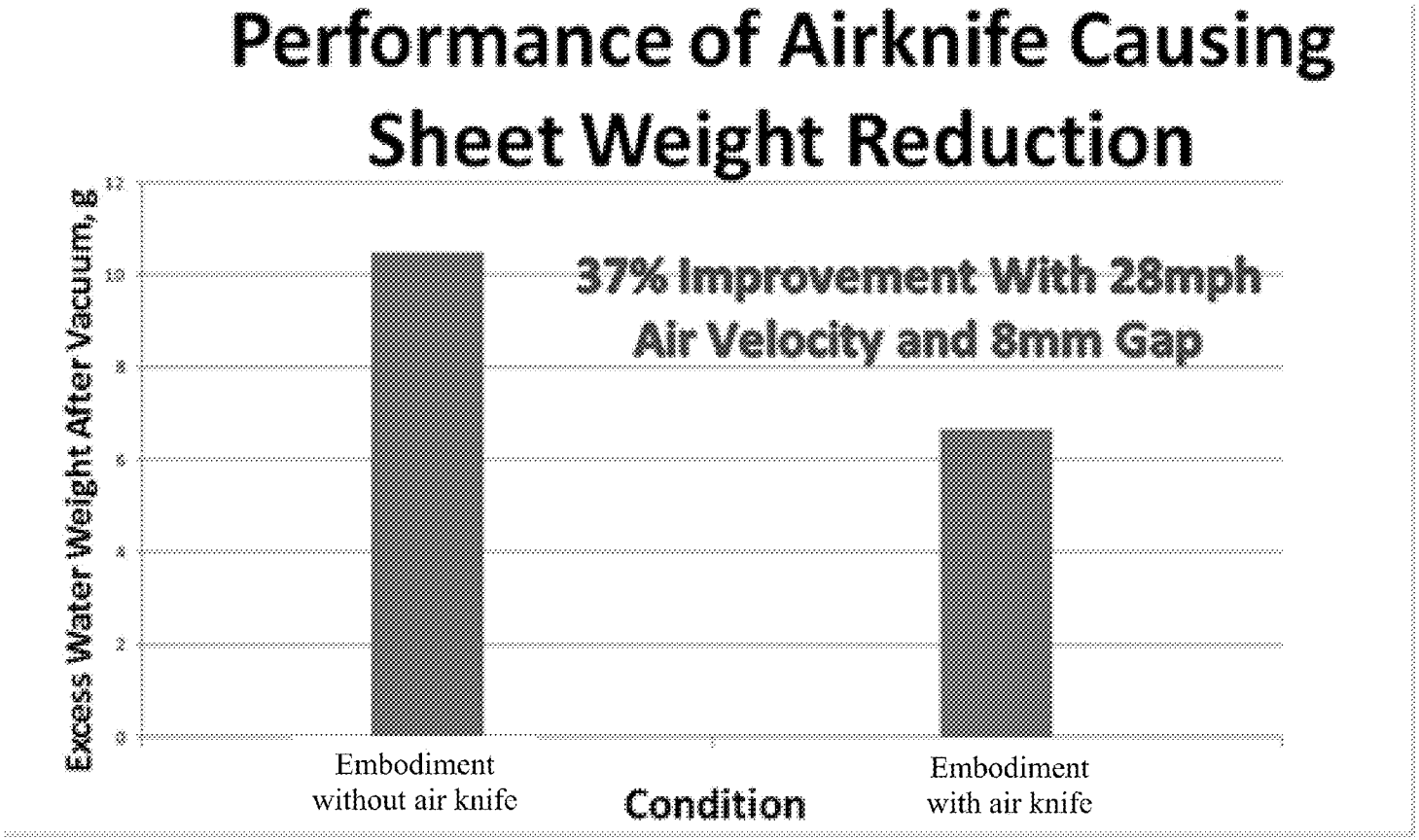
FIG. 5 sets forth the results of excess water weight after drying and dewatering using an embodiment without an air knife and an embodiment with an air knife.

In some embodiments, air knife 2 may be omitted from system 1. However, superior performance of system 1 may be achieved when air knife 2 is included. Experiments using an embodiment without an air knife and with an air knife were conducted. FIG. 5 sets forth experimental results comparing excess water weights after drying for the two types of embodiments. As shown in the experimental results, superior drying results were achieved using embodiments with air knife 2. Ion some embodiments, air knife operation and benefits thereof may be independent of forming wire construction by percent removal.

Figure 6B:
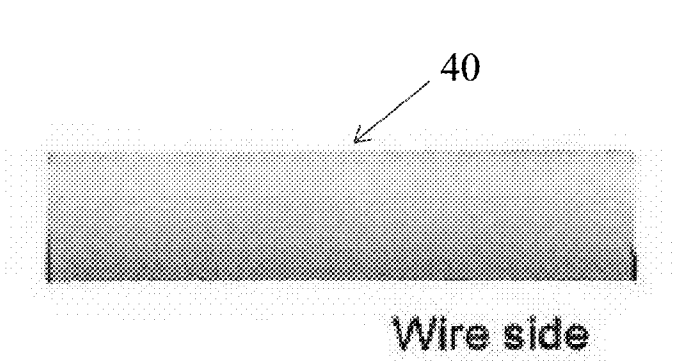
FIG. 6B is a cross-sectional view of fibrous nonwoven materials dried using a drying and dewatering system with an air knife in accordance with a specific example embodiment of the disclosure.
Figure 6A:
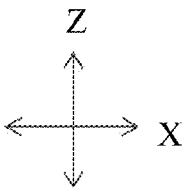
FIG. 6A is a cross-sectional view of fibrous nonwoven materials dried using a drying and dewatering system without an air knife in accordance with a specific example embodiment of the disclosure.
Figure 6A:
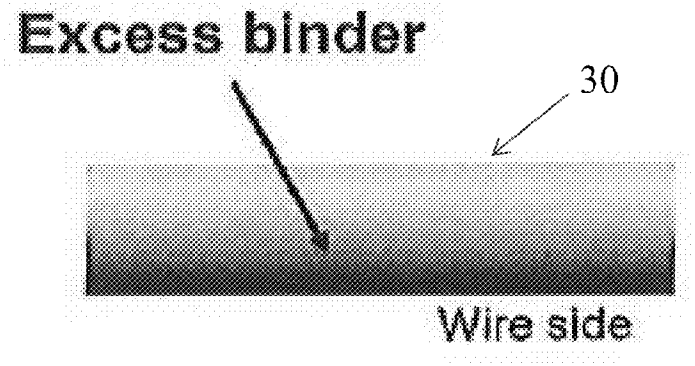

FIG. 6A and FIG. 6B are cross-sectional views of wet-laid fibrous nonwoven materials 30 and 40 treated with binding agent. FIG. 6A illustrates a binding agent distribution along a z-axis of wet-laid fibrous nonwoven materials 30 dried and dewatered using a system without air knife 2. FIG. 6B illustrates a binding agent distribution along a z-axis of wet-laid fibrous nonwoven materials 40 dried and dewatered using the system according to operation 20. A comparison of FIG. 6A and FIG. 6B shows that wet-laid fibrous nonwoven materials 40 exhibit more uniform binding agent distribution along a z-axis of wet-laid fibrous nonwoven materials 40. More uniform binding agent distribution may be achieved because air knife 2 may be operable to force air at high velocity through wet-laid fibrous nonwoven material 40 thereby pushing and forcing excess binding agent from wet-laid fibrous nonwoven material 40 into vacuum slot 4. Vacuum slot 4, positioned below wet-laid fibrous nonwoven material 40, may be operable to facilitate removal of excess binding agent and enhance uniform distribution of binding agent within wet-laid fibrous nonwoven material 40. In some circumstances, too much binder at a bottom of a mat may starve wires of binder at a top because of weight control dynamics.

In some embodiments, drying system 1 may be operable to dry or dewater wet-laid fibrous nonwoven materials 6 in a manner that may result in patterned distributions of moisture along the x or y-axis of the wet-laid fibrous nonwoven materials 6, or gradient distributions of moisture along the z-axis of the wet-laid fibrous nonwoven materials 6. Air knife 2 and vacuum slot 4, separately or together, may be operated at intermittent intervals, may be intermittently blocked, or may be operated at varying air velocities during the drying or dewatering process to result in patterned or gradient distributions of moisture throughout the wet-laid fibrous nonwoven materials 6. In another exemplary embodiment, drying system 1 may be operable to result in patterned distributions of binding agent along the x or y-axis of the wet-laid fibrous nonwoven materials 6, or gradient distributions of binding agent along the z-axis of wet-laid fibrous nonwoven materials 6. Air knife 2 and vacuum slot 4 may, separately or together, be operated at intermittent intervals or may be operated at varying air velocities during the drying or dewatering process to result in patterned or gradient distributions of binding agent through the wet-laid fibrous nonwoven materials 6. A patterned or gradient distribution of binding agent may be preferred for aesthetical reasons or to achieve particularized variance in the structural integrity of wet-laid fibrous nonwoven materials 6.

In some embodiments, drying system 1 may be operable to facilitate and enhance extraction of residual liquid from wet-laid fibrous nonwoven materials 6 so as to reduce the time needed to dry or dewater wet-laid fibrous nonwoven materials. Wet-laid fibrous nonwoven materials 6 may be dried with vacuum systems or heating devices, such as an oven. The use of present embodiments may serve to reduce oven drying time, reduce heater capacity, and/or increase line speeds for drying processes and systems. In some embodiments, drying system 1 may provide for reduced fluid carryover into the binder system which may advantageously allow for improved binder control and reduced loss due to over-dilution.

In some embodiments, drying system 1 may be operable to facilitate and enhance the uniform distribution of binding agent in wet-laid fibrous nonwoven materials 6. The use of present embodiments may reduce the moisture content of wet-laid fibrous nonwoven materials 6 in a manner that promotes higher binding agent adherence, better resin retention, and/or superior structural integrity throughout wet-laid fibrous nonwoven materials 6. In some embodiments, more consistent physical properties of a mat may be achieved through use of drying system 1. In some embodiments, use of drying system 1 may advantageously provide for a more consistent drying process.

In some embodiments, drying system 1 may be operable to remove residual white water on a fiberglass mat by 10-50% depending on settings of a vacuum slot, air velocity, line speed of forming wire, and transfer speed of mat through system. In some embodiments, it may not be advantageous to removal all white water. Removal of all white water may prevent a mat from transferring well from a forming section to a binder section.

As will be understood by those skilled in the art who have the benefit of the instant disclosure, other equivalent or alternative compositions, devices, methods, and systems for cutting and/or drying wet-laid fibrous nonwoven materials can be envisioned without departing from the description contained herein. Accordingly, the manner of carrying out the disclosure as shown and described is to be construed as illustrative only.

Persons skilled in the art may make various changes in the shape, size, number, and/or arrangement of parts without departing from the scope of the instant disclosure. For example, the position and number of air knives and vacuum devices may be varied. Air velocity and/or negative pressure may be varied independently or interdependently according to some embodiments. For example, air speed may be decreased as the strength of the vacuum increases. Similarly, air speed may be increased as the vacuum strength decreases (e.g., to maintain a substantially constant pressure drop across a gap and slot. In addition, the size of a device and/or system may be scaled up or down to suit the needs and/or desires of a practitioner. Each disclosed method and method step may be performed in association with any other disclosed method or method step and in any order according to some embodiments. Where the verb "may" appears, it is intended to convey an optional and/or permissive condition, but its use is not intended to suggest any lack of operability unless otherwise indicated. Persons skilled in the art may make various changes in methods of preparing and using a composition, device, and/or system of the disclosure.

Also, where ranges have been provided, the disclosed endpoints may be treated as exact and/or approximations as desired or demanded by the particular embodiment. Where the endpoints are approximate, the degree of flexibility may vary in proportion to the order of magnitude of the range. For example, on one hand, a range endpoint of about 50 in the context of a range of about 5 to about 50 may include 50.5, but not 52.5 or 55 and, on the other hand, a range endpoint of about 50 in the context of a range of about 0.5 to about 50 may include 55, but not 60 or 75. In addition, it may be desirable, in some embodiments, to mix and match range endpoints. Also, in some embodiments, each figure disclosed (e.g., in one or more of the examples, tables, and/or drawings) may form the basis of a range (e.g., depicted value +/− about 10%, depicted value +/− about 50%, depicted value +/− about 100%) and/or a range endpoint. With respect to the former, a value of 50 depicted in an example, table, and/or drawing may form the basis of a range of, for example, about 45 to about 55, about 25 to about 100, and/or about 0 to about 100.

All or a portion of a device and/or system for drying systems of wet-laid fibrous nonwoven materials may be configured and arranged to be disposable, serviceable, interchangeable, and/or replaceable. These equivalents and alternatives along with obvious changes and modifications are intended to be included within the scope of the present disclosure. Accordingly, the foregoing disclosure is intended to be illustrative, but not limiting, of the scope of the disclosure as illustrated by the appended claims.

The title, abstract, background, and headings are provided in compliance with regulations and/or for the convenience of the reader. They include no admissions as to the scope and content of prior art and no limitations applicable to all disclosed embodiments.

What is claimed is:

1. An air system for drying a fibrous material, the air system comprising:

an air knife operable to emit air at the fibrous material;

a slot defined in a surface of a vacuum device operable to draw air through the slot; and a movable forming wire structure operable to pass the fibrous material thereon;

wherein the air knife and the surface of the vacuum device are spaced apart by a gap, the gap configured to have a height to allow the fibrous material to pass therethrough;

wherein the slot is operable to provide suction on the fibrous material so as to extract liquid from the fibrous material into the slot; and wherein the air knife is disposed above the movable forming wire structure and oriented at substantially perpendicular angle relative to a plane defined by the movable forming wire.

2. An air system according to claim 1, wherein the air knife is operable to emit air at velocities of about 28 mph.

3. An air system according to claim 1, wherein the gap is about 8 mm.

4. An air system according to claim 1, wherein the liquid is residual water, and wherein the air knife further comprises a manifold operable to distribute air flow through the air knife.

5. An air system according to claim 1, further comprising a compressor operable to promote even distribution of air flow through the air knife.

6. An air system according to claim 1, further comprising a solenoid valve operable to cut off air flow to the air knife.

7. An air system according to claim 1, wherein an air flow direction provided by the air knife and a vacuum direction provided by the vacuum device are co-linear.

8. An air system according to claim 1, wherein the movable forming wire structure allows fluids to pass therethrough.

9. An air system according to claim 1, wherein the air system is further operable to provide patterned distributions of moisture in the fibrous material.

10. A drying system for drying a fibrous material, the drying system comprising:

an air knife defining a positive pressure air flow path;

a slot defined in a surface of a vacuum device, the slot defining a negative pressure air flow path; and a movable forming wire structure;

wherein the air knife and the surface of the vacuum device are spaced apart by a gap, the gap configured to have a height to allow the fibrous material to pass therethrough;

wherein the positive pressure air flow path and the negative air flow path are parallel and are operable to direct a positive pressure air flow from the air knife towards the slot so as to push liquid out of the fibrous material and into the slot when the fibrous material makes contact with the positive pressure air flow; and wherein the air knife is oriented at substantially perpendicular angle relative to a plane defined by the movable forming wire.

11. A drying system according to claim 10, wherein the liquid is residual water, and wherein the positive pressure air flow path and the negative air flow path are co-linear across the gap.

12. A drying system according to claim 10, wherein the fibrous material comprises a binding agent distributed therein, wherein the positive pressure air flow direction and the negative air flow direction further direct the positive pressure air flow to pass through the fibrous material such that the binding agent is distributed substantially uniformly throughout the fibrous material.

13. A drying system according to claim 10, wherein the fibrous material comprises moisture distributed therein, wherein the positive pressure air flow direction and the negative air flow direction further direct the positive pressure air flow to pass through the fibrous material at intermittent time intervals as to generate gradient distributions of the moisture along a horizontal direction.

14. An air system for preparing a fibrous material, the air system comprising:

an air knife comprising a positive pressure air flow direction;

a slot defined in a surface of a vacuum device, the slot comprising a negative pressure air flow direction; and a movable forming wire structure;

wherein the air knife and the surface of the vacuum device are spaced apart by a gap, the gap configured to have a height to allow the fibrous material to pass therethrough;

wherein the positive pressure air flow direction and the negative air flow direction are parallel and direct a positive pressure air flow from the air knife towards the slot so as to push liquid out of the fibrous material and into the slot when the fibrous material makes contact with the positive pressure air flow; and wherein the air knife is oriented at an about 45 degrees angle relative to a plane defined by the movable forming wire.

15. An air system according to claim 14, wherein the positive pressure air flow direction and the negative air flow direction are co-linear across the gap.

16. A drying system for drying a fibrous material, the drying system comprising:

an air knife comprising a positive pressure air flow direction;

a manifold in fluid communication with the air knife;

a compressor in fluid communication with the manifold;

a solenoid valve disposed upstream of the air knife and operable to cut off air flow to the air knife;

a slot defined in a surface of a vacuum device, the slot comprising a negative pressure air flow direction; and a movable forming wire structure;

wherein the air knife and the surface of the vacuum device are spaced apart by a gap, the gap configured to have a height to allow the fibrous material to pass therethrough;

wherein the positive pressure air flow direction and the negative air flow direction are parallel and direct a positive pressure air flow from the air knife towards the slot so as to push liquid out of the fibrous material and into the slot when the fibrous material makes contact with the positive pressure air flow; and wherein the air knife is oriented at substantially perpendicular angle relative to a plane defined by the movable forming wire.

17. A drying system according to claim 16, wherein the positive pressure air flow direction and the negative air flow direction are co-linear across the gap.

* * * * *